US006519786B1

(12) United States Patent
Francis

(10) Patent No.: US 6,519,786 B1
(45) Date of Patent: Feb. 18, 2003

(54) TOILET SPLASH SHIELD SYSTEM

(76) Inventor: Robert A. Francis, 55 Pacifica Ave. Space 48, Bay Point, CA (US) 94565

( * ) Notice: Subject to any disclaimer, the term of this patent is extended or adjusted under 35 U.S.C. 154(b) by 11 days.

(21) Appl. No.: 09/697,975

(22) Filed: Oct. 26, 2000

(51) Int. Cl.[7] ..... E03D 9/00

(52) U.S. Cl. ..... 4/300.3; 4/213; 4/216; 4/217; 4/209 FF; 4/352; 4/420

(58) Field of Search ..... 4/300.3, 652, 213, 4/216, 217, 209 FF, DIG. 5, 420, 420.2

(56) References Cited

U.S. PATENT DOCUMENTS

| | | | | |
|---|---|---|---|---|
| 2,172,506 A | | 9/1939 | Gerger | |
| 3,332,334 A | | 7/1967 | Melzer | |
| 3,659,296 A | * | 5/1972 | Stamper | 4/217 |
| 3,931,649 A | | 1/1976 | Jankowski | |
| 4,063,316 A | | 12/1977 | Hünninghaus | |
| 4,123,967 A | | 11/1978 | Shanis | |
| 4,709,426 A | | 12/1987 | Godwin, Jr. | |
| 5,031,259 A | | 7/1991 | Baiera et al. | |
| 5,241,712 A | | 9/1993 | Mahoney | |
| D353,659 S | | 12/1994 | Hall | |
| 6,041,451 A | | 3/2000 | Francis | |

* cited by examiner

*Primary Examiner*—Gregory Huson
*Assistant Examiner*—Kathleen J. Prunner

(57) ABSTRACT

The toilet splash shield system prevents urine and waste from splashing out of a toilet bowl, and includes a toilet bowl having a rim having upper and lower sides and front and back ends. The rim has a bore extending therethrough, and the bore is in communication with an air pump. The rim has a plurality of vent holes extending into the bore from an inner perimeter of the rim. Further, the rim has a vent in communication with the bore for permitting passage of air from the bore through an inner perimeter of the rim.

12 Claims, 16 Drawing Sheets

26
10
16
12
23
24
18
17
19
23
15

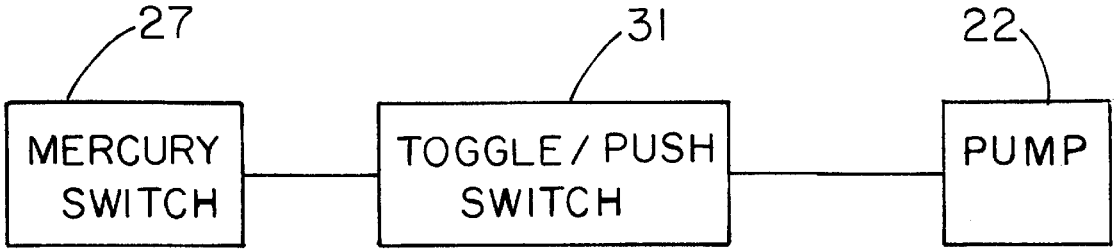
FIG. 4
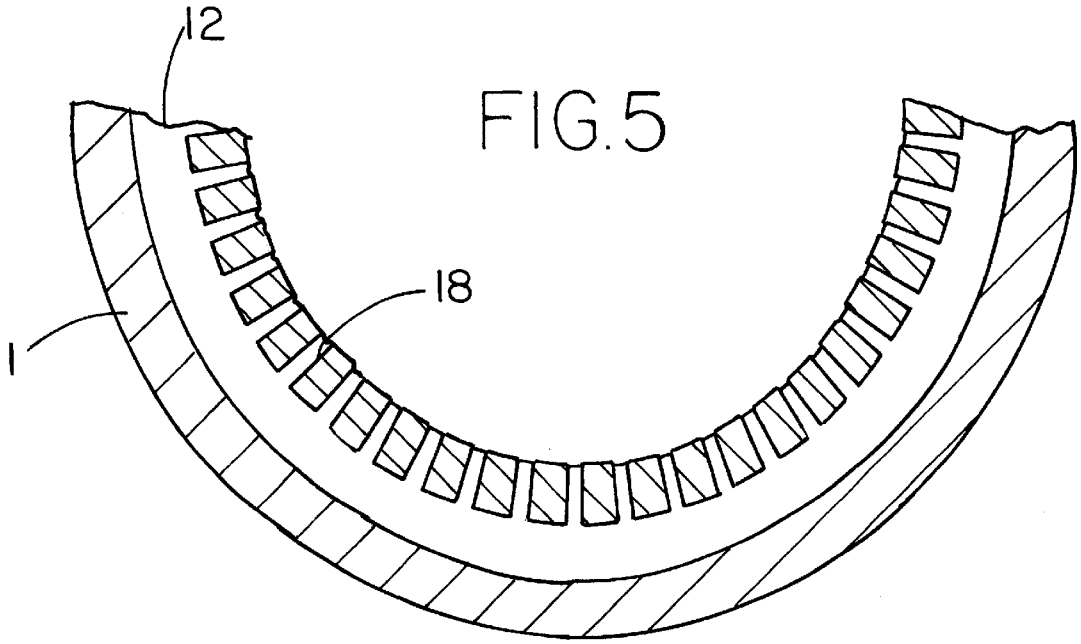
FIG. 5
FIG. 6
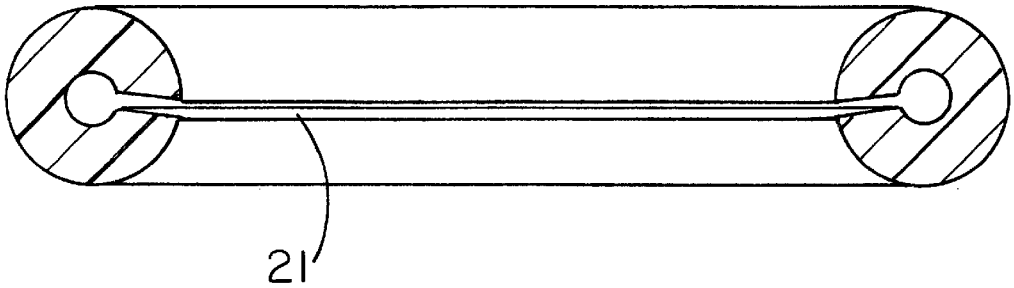

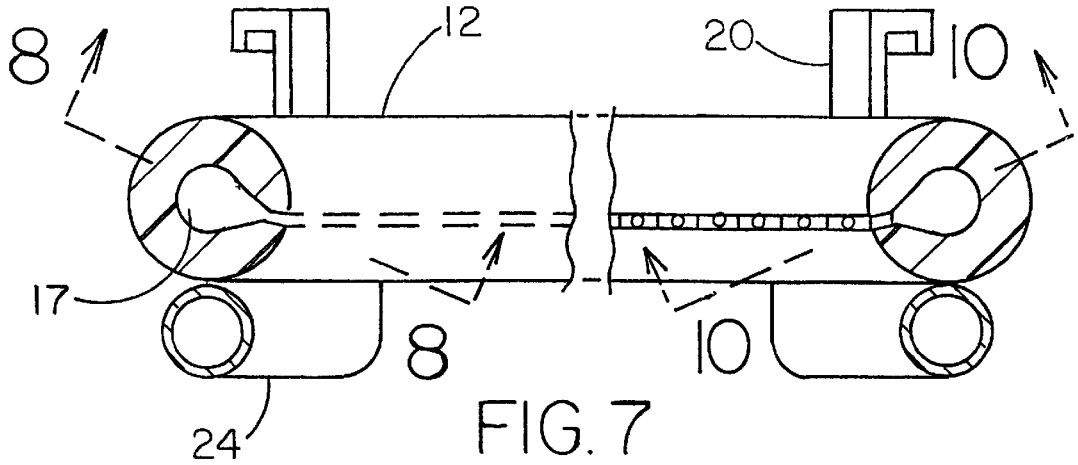
FIG. 7
FIG. 8
FIG. 10
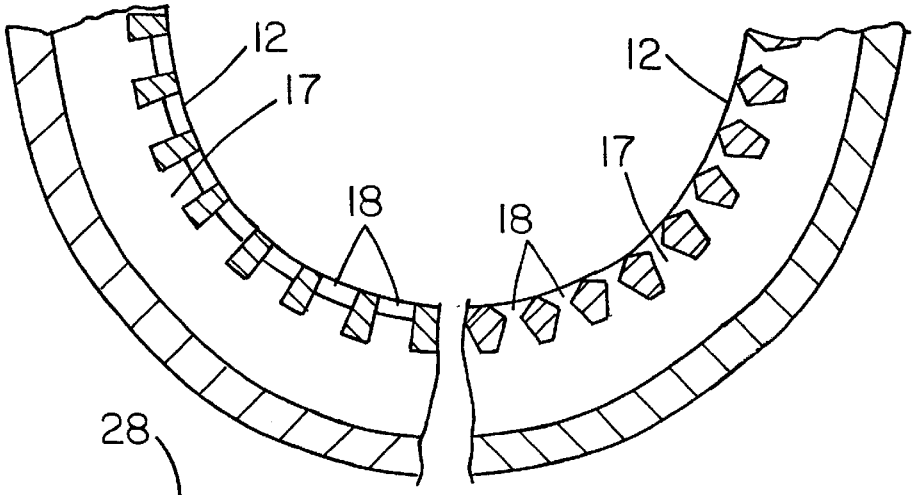
FIG. 9
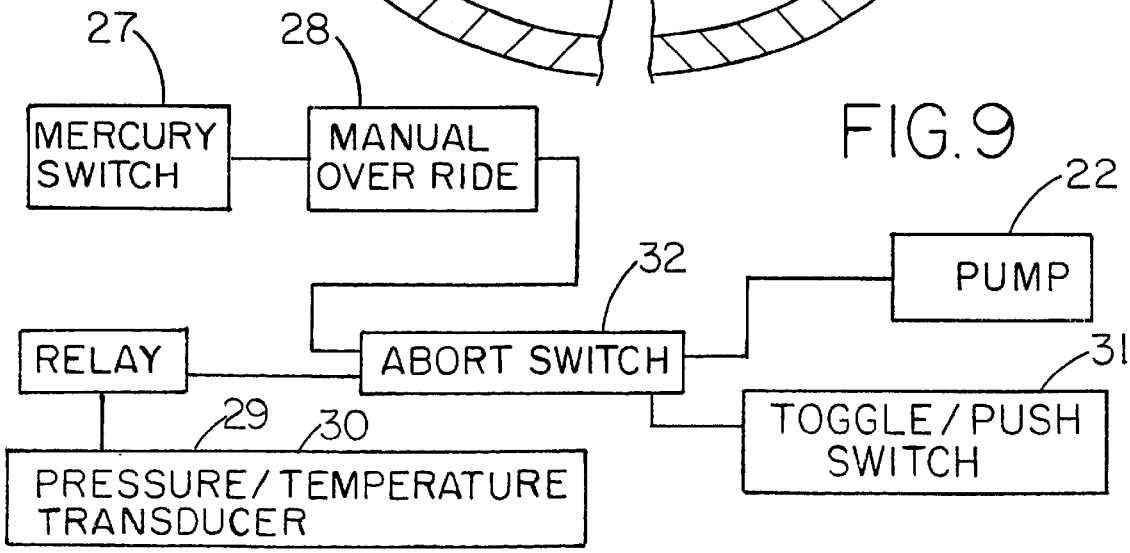

TOILET SPLASH SHIELD SYSTEM

BACKGROUND OF THE INVENTION

The present invention relates to splash guards and more particularly pertains to an improved toilet splash shield system for preventing urine and waste from splashing out of a toilet bowl.

The use of splash guards is known in the prior art. More specifically, splash guards heretofore devised and utilized are known to consist basically of familiar, expected and obvious structural configurations, notwithstanding the myriad of designs encompassed by the crowded prior art which have been developed for the fulfillment of countless objectives and requirements.

One especially useful toilet splash shield system is disclosed in my U.S. Pat. No. 6,041,451. Although the system described in the 6,041,451 patent is highly useful, some aspects of the invention, especially those involving systems which are integral with a toilet, could benefit from further improved structure and enhanced function. One illustrative area for improvement is the movement of air into the interior of the bowl by the splash shielding system, which may cause a buildup of air pressure in the bowl interior, especially when a user is seated on the seat of the toilet. Another illustrative area for improvement is the flow patterns of air blown into the bowl by the splash prevention system.

The improved toilet splash shield system according to the present invention substantially departs from the conventional concepts and designs of the prior art, and in so doing provides an apparatus primarily developed for the purpose of preventing urine and waste from splashing out of a toilet bowl.

SUMMARY OF THE INVENTION

The present invention provides an improved toilet splash shield system wherein the same can be utilized for preventing urine and waste from splashing out of a toilet bowl.

The general purpose of the present invention, which will be described subsequently in greater detail, is to provide an improved toilet splash shield system which has many of the advantages of the splash guards mentioned heretofore and many novel features that result in an improved toilet splash shield system which is not anticipated, rendered obvious, suggested, or even implied by any of the prior art splash guards, either alone or in any combination thereof.

To attain this, the present invention generally comprises a toilet bowl comprising a rim having upper and lower sides and front and back ends. The rim has a bore extending therethrough, and the bore is in communication with an air pump. The rim has a plurality of vent holes extending into the bore from an inner perimeter of the rim. Further, the rim has a vent means in communication with the bore for permitting passage of air from the bore through an inner perimeter of the rim.

Optionally, the rim may include an upper portion and a lower portion, with the upper portion of the rim being separable from and removably mounted on the lower portion of the rim.

Other optional aspects of the present invention include a gasket member for blocking air flow between the seat and the rim of a toilet. The gasket member is mounted on a lower face of the seat so that the gasket member is positionable between the seat and the upper side of the rim when the seat is located in the lowered position.

Yet another optional aspect of the present invention is an air directing member provided on the lower face of the seat for directing air flowing adjacent to the lower face of the seat.

Still another optional aspect of the present invention is an air exhaust structure provided for exhausting air from the interior of the bowl.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide an improved toilet splash shield system which has many of the advantages of the splash guards mentioned heretofore and many novel features that result in an improved toilet splash shield system which is not anticipated, rendered obvious, suggested, or even implied by any of the prior art splash guards, either alone or in any combination thereof.

It is another object of the present invention to provide an improved toilet splash shield system which may be easily and efficiently manufactured by employing a split rim structure for a toilet that facilitates forming a bore and a plurality of vent holes in the rim.

It is a further object of the present invention to provide an improved toilet splash shield system which is of a durable and reliable construction.

An even further object of the present invention is to provide an improved toilet splash shield system which is susceptible of a low cost of manufacture with regard to both materials and labor, and which accordingly is then susceptible of low prices of sale to the consuming public, thereby making such improved toilet splash shield system economically available to the buying public.

Still yet another object of the present invention is to provide an improved toilet splash shield system which provides in the apparatuses and methods of the prior art some of the advantages thereof, while simultaneously overcoming some of the disadvantages normally associated therewith.

Still another object of the present invention is to provide an improved toilet splash shield system for preventing urine and waste from splashing out of a toilet bowl.

Yet another object of the present invention is to provide an improved toilet splash shield system which includes a toilet bowl comprising a rim having upper and lower sides and front and back ends. The rim has a bore extending therethrough, and the bore is in communication with an air pump. The rim has a plurality of vent holes extending into the bore from an inner perimeter of the rim. Further, the rim has a vent means in communication with the bore for permitting passage of air from the bore through an inner perimeter of the rim.

Still yet another object of the present invention is to provide an improved toilet splash shield system that manipulates air flow to keep splashes and waste in the toilet bowl. In particular, air is ejected through closely spaced vent holes, creating a blanket effect that permits a stream of liquid to pass down through the "air blanket," but would prevent splashes from coming up through the air blanket.

Even still another object of the present invention is to provide an improved toilet splash shield system that may turn on automatically when the toilet lid is lifted, or may have a switch that is activated by body heat.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a diagram illustrating a switch system for controlling the air pump of the present invention.

FIG. 5 is a schematic cross sectional view of the present invention.

FIG. 6 is a schematic cross sectional view of an alternate embodiment of the present invention.

FIG. 7 is a schematic cross sectional view of the present invention illustrating two different configurations of vent holes.

FIG. 8 is a schematic cross sectional view of the present invention taken from line 8—8 of FIG. 7.

FIG. 9 is a diagram illustrating a switch system for controlling the air pump of the present invention.

FIG. 10 is a schematic cross sectional view of the present invention taken from line 10—10 of FIG. 7.

DESCRIPTION OF THE PREFERRED EMBODIMENT

Figure 1:
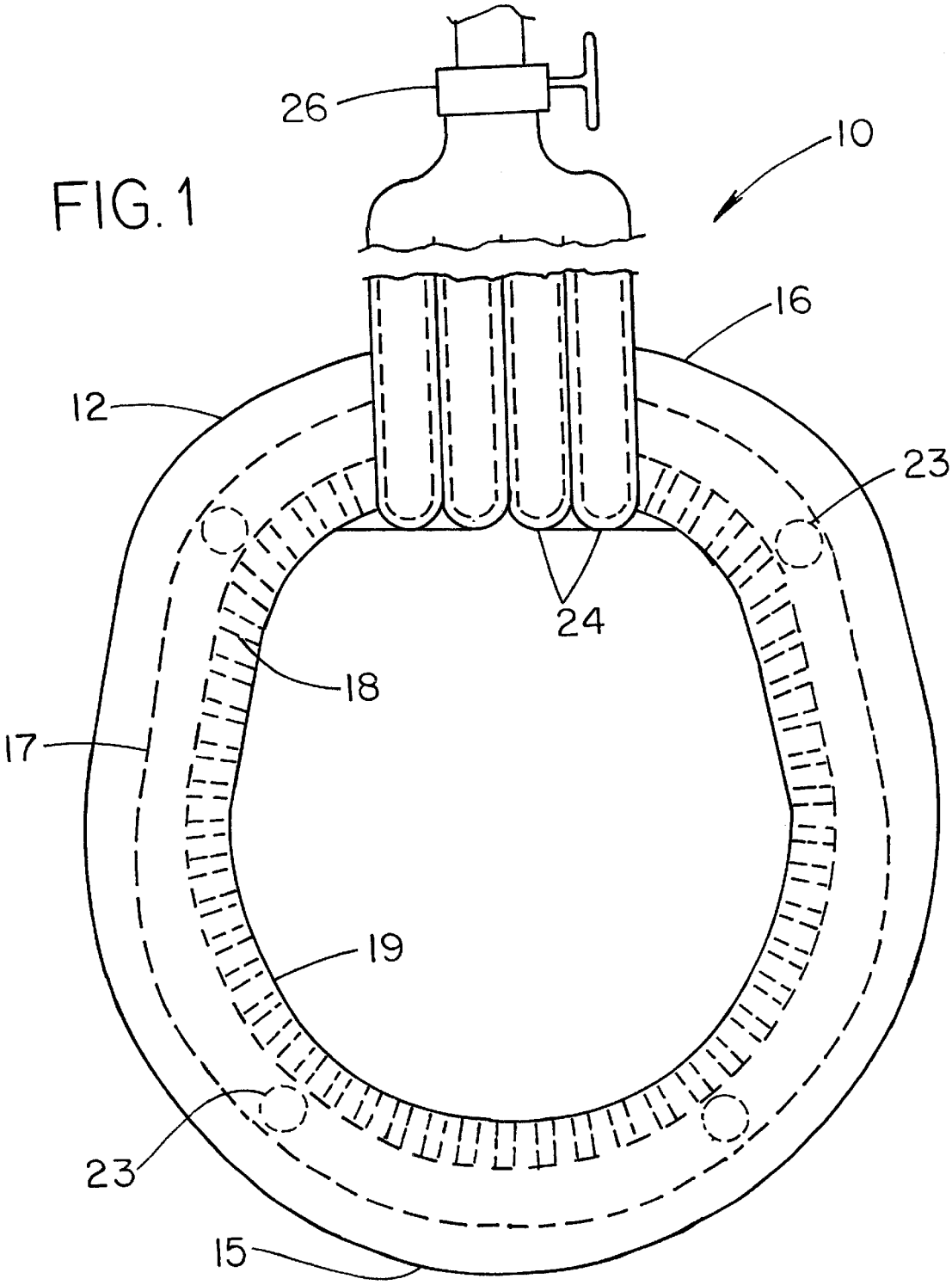
FIG. 1 is a schematic side view of an improved toilet splash shield system according to the present invention.

With reference now to the drawings, and in particular to FIGS. 1 through 24 thereof, an improved toilet splash shield system embodying the principles and concepts of the present invention and generally designated by the reference numeral 10 will be described.

As best illustrated in FIGS. 1 through 5, the splash shield 10 for a toilet generally comprises an annular main portion 12 designed for mounting below a rim 1 of a toilet bowl 2. The main portion has upper and lower sides 13, 14 and front and back ends 15, 16. The main portion has a bore 17 extending through it. The bore is in communication with a source of pressurized air. The main portion has a plurality of vent holes 18 extending into the bore from an inner perimeter 19 of the main portion.

Preferably, the inner periphery of the main portion is vertically flush with an inner periphery of the rim of the toilet bowl so that it does not lessen the area of the bowl opening into which a user may urinate.

Also preferably, a plurality of generally J-shaped support hooks 20, ideally four hooks each positioned 90 degrees from each other, extend from the main portion and are designed for hooking to the rim of the toilet bowl.

Preferably, the vent holes are angled downwardly at an angle of at least one degree from a horizontal plane. The most effective range is between at least 1 degree and about 30 degrees downward from the horizontal. The angling needs to be at least 1 degree so that when air streams form opposing vent holes come in contact with each other, the air will not rebound upward. The holes should not be angled beyond 45 degrees or the jets of air will not be effective.

Figure 3:
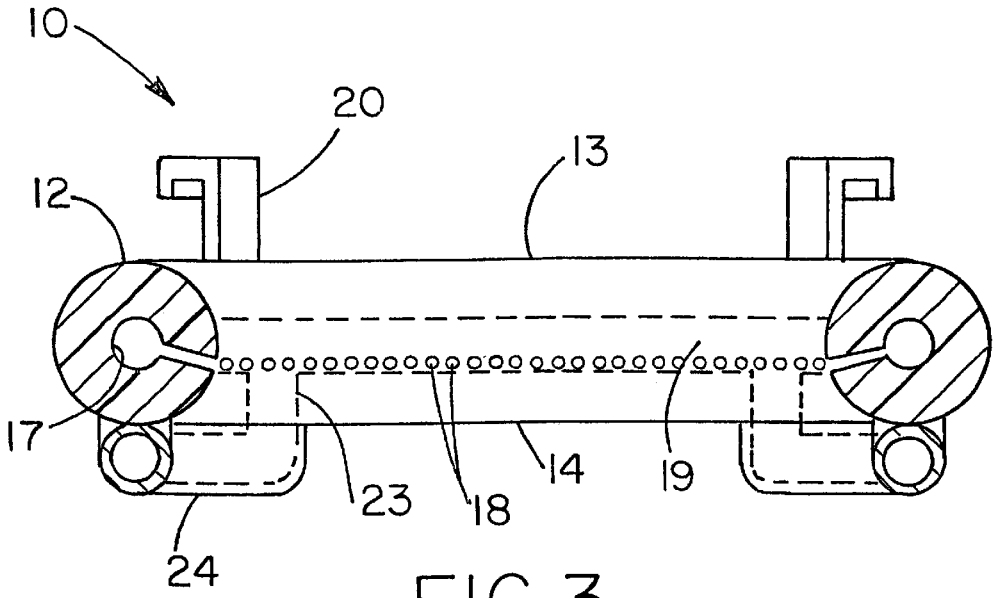
FIG. 3 is a schematic cross sectional view of the present invention taken from line 3—3 of FIG. 2.
Figure 2:
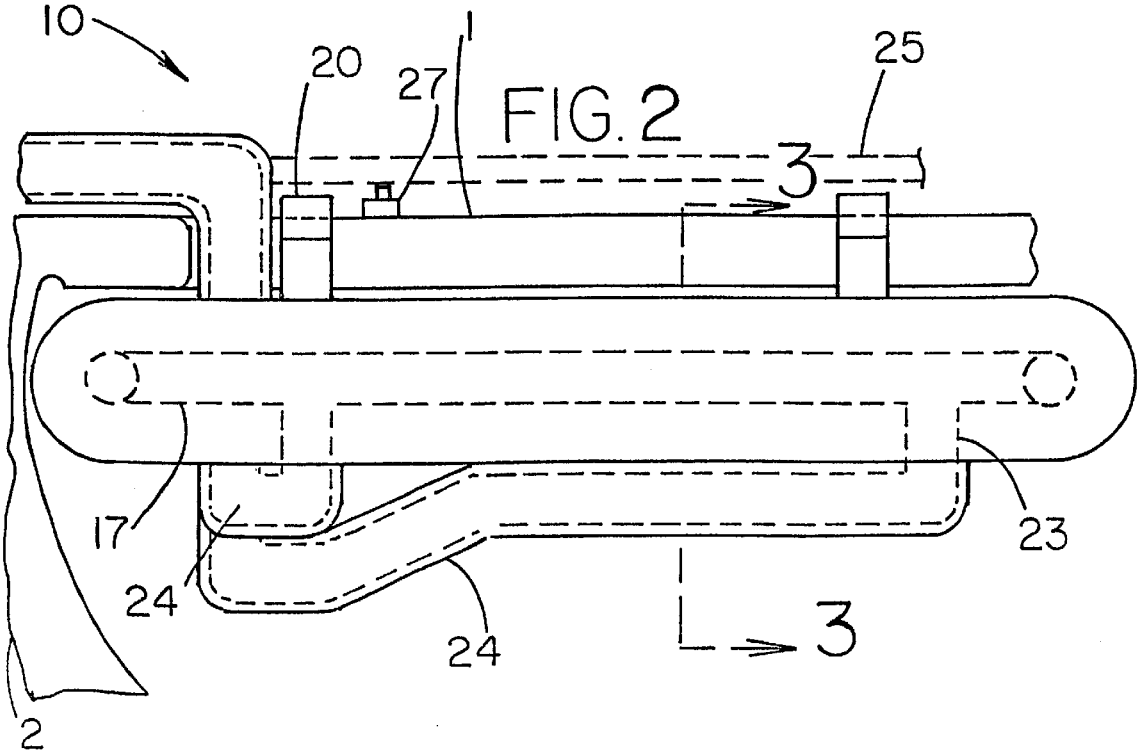
FIG. 2 is a schematic side view of the present invention.

The vent holes may be round or tubular, as shown in FIGS. 1, 3, and 5. Alternate vent holes include a rectangular configuration, shown in FIGS. 7 and 8, and conical vent holes, shown in FIGS. 7 and 10. The rectangular vent holes provide more of a blanket of air than the circular version. The jets of air ejected from the conical vent holes travel faster than the air exiting the round vent holes. In any of these embodiments, the bore could extend out and taper together towards the vent holes, as best seen in FIG. 7.

Where round vent holes are used, an inner diameter of each of the vent holes is preferably between 1 and 5 mm. Also preferably, the vent holes are spaced between 3 and 10 mm apart from outer edges thereof. This spacing is close enough that a "shield" effect is created, much like a blanket of air, through which splashes cannot travel.

Alternatively, as illustrated in FIG. 6, the main portion could have a vent slot 21 extending outwardly from the bore through an inner perimeter of the main portion. Again, the vent slot should be angled downwardly at an angle of at least one degree from a horizontal plane, but not over 45 degrees.

Preferably, an air pump 22 provides the source of compressed air and is in communication with the bore of the main portion. The air pump should be capable of producing an output of 10 to 500 psi. Exemplary air pumps include rotary blowers as well as fans with radial blades.

Also preferably, the lower side of the main portion has four openings 23 into the bore. Ideally, the openings are positioned at 90 degree intervals about the main portion. Four air supply lines 24 are connected to the openings of the main portion and in fluid communication with the air pump. Ideally, the air supply lines extend along the lower side of the main portion so that they do not obstruct installation of the device nor be an obstruction that would splash urine out of the bowl if urinated upon.

Preferably, the air supply lines extend around an inner portion of the back end of the main portion and over the rim of the toilet bowl and between the hinges of the toilet seat 25 to the air pump. Ideally, the air supply lines taper together and open into a single tube, which has an air pressure adjustment valve 26 for adjusting the volume of air travelling to the main portion.

A seat switch 27 may be mounted to an upper surface of the rim of the toilet bowl and be in electrical communication with the air pump. The switch would activate the pump when the toilet seat is raised. The switch would deactivate the pump when the toilet seat is lowered.

An override switch 28 may disconnect the seat switch from the air pump. This would be useful in a household having children or child guests who would play with the toilet seat merely to activate the device. More importantly, it would allow the user to turn the air pump off when cleaning the toilet bowl.

Alternatively or in any combination with the above switches, a pressure transducer 29 is coupled to an upper surface of a toilet seat and in communication with the air pump. The pressure transducer activates the air pump when a user sits on the toilet seat.

Alternatively or in any combination with the above switches, a temperature transducer 30 is coupled to an upper surface of a toilet seat and in communication with the air pump. The temperature transducer senses the body heat of a user sitting on the toilet seat whereupon it activates the air pump.

Alternatively or in any combination with the above switches, an auxiliary switch 31 may be in communication with the air pump for selectively activating the air pump independent of the seat switch. This would be used when the seat is not raised and would ideally be located near the toilet flushing handle for convenience.

Alternatively or in any combination with the above switches, an abort switch 32 may be used to deactivate the air pump. As shown in FIG. 9, all of the switches would be connected to the abort switch. The abort switch allows a user to completely shut down the system, especially necessary when cleaning the toilet, where any of the number of switches could be accidentally activated.

In use, the main portion is installed in a toilet bowl with the vent holes aiming downward. The air pressure is set so that the shield of air created by the air escaping the vents is weak enough to allow the penetration of a stream of liquid (such as urine) but strong enough to prohibit any back or upward splash of liquids that would ordinarily splash onto the rim or completely out of the bowl. The switches control activation of the pump substantially as set forth above.

In an alternate embodiment, shown in FIGS. 11 through 18, the device is integrated into a toilet bowl. In such an embodiment, a rim 43 of the toilet bowl has upper and lower sides and front and back ends. The rim has a bore 41 extending through it. The bore is in communication with a source of pressurized air.

The rim has a plurality of vent holes 42 extending into the bore from an inner perimeter of the rim. The vent holes are angled downwardly at an angle of at least one degree from a horizontal plane. The most effective range is between at least 1 degree and about 30 degrees downward from the horizontal. The angling needs to be at least 1 degree so that when air streams form opposing vent holes come in contact with each other, the air will not rebound upward. The holes should not be angled beyond 45 degrees or the jets of air will not be effective.

Figure 11:
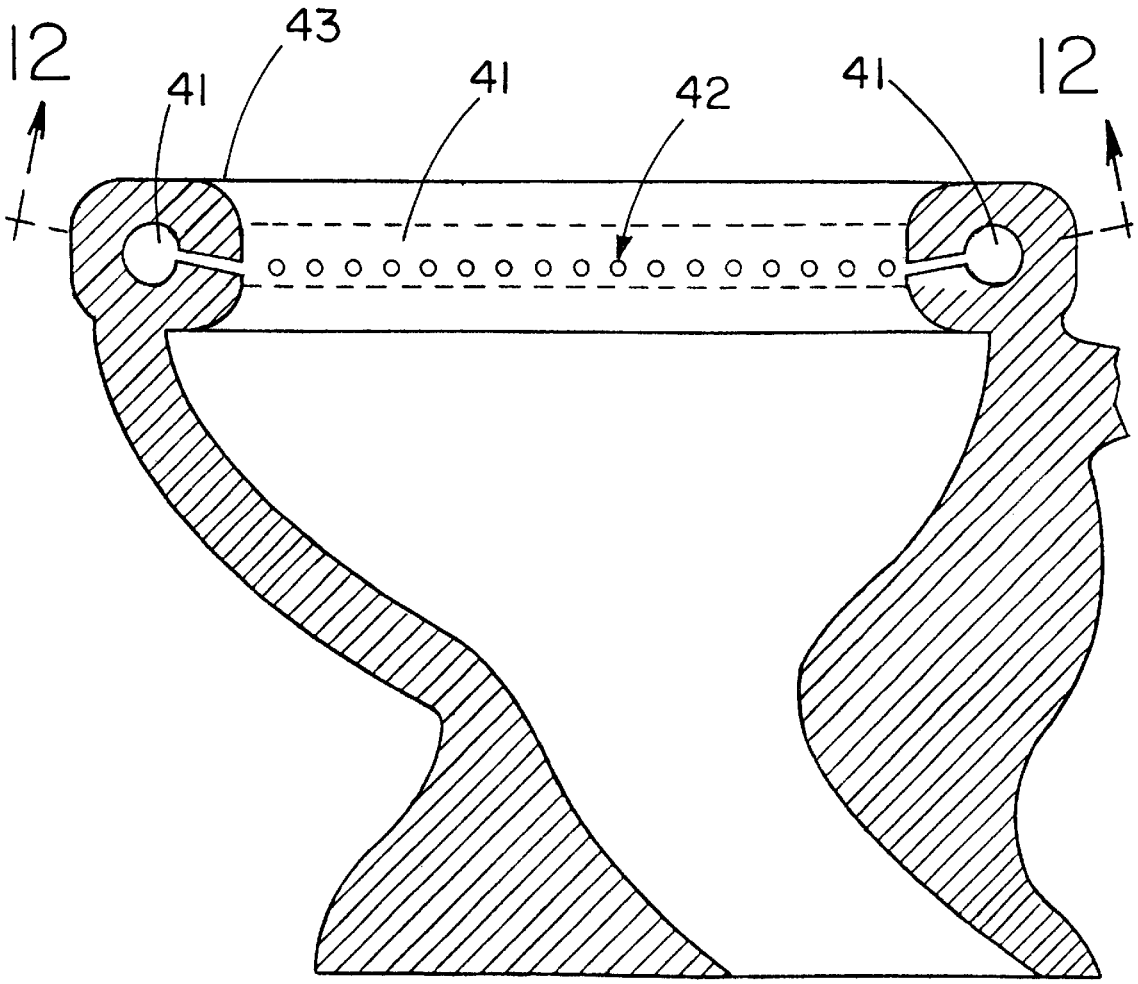
FIG. 11 is a schematic cross sectional view of an integrated version according to the present invention.
Figure 12:
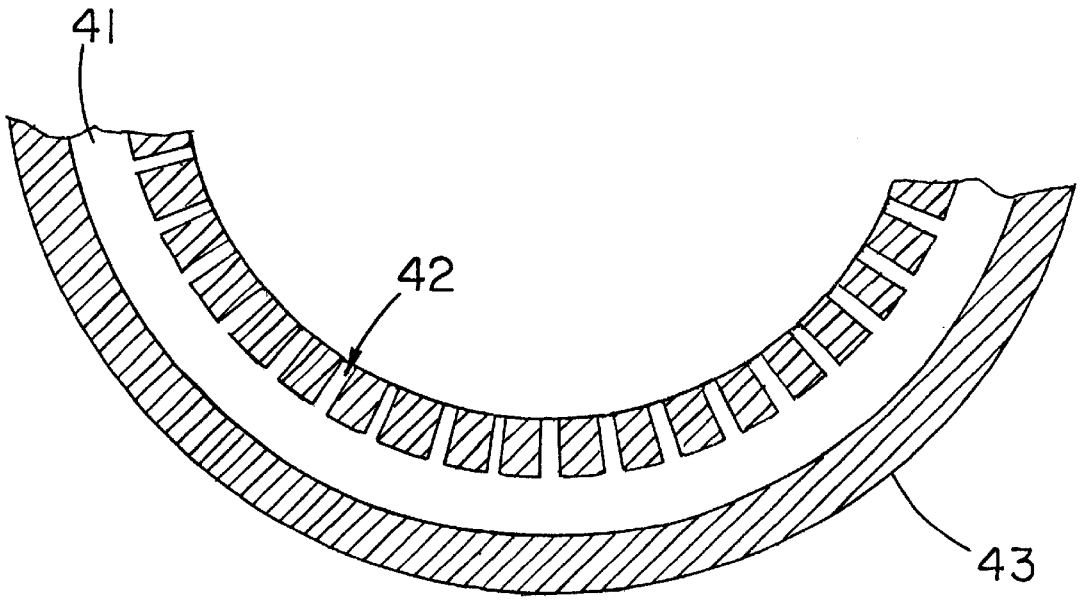
FIG. 12 is a schematic cross sectional view of the present invention taken from line 12—12 of FIG. 11.
Figure 13:
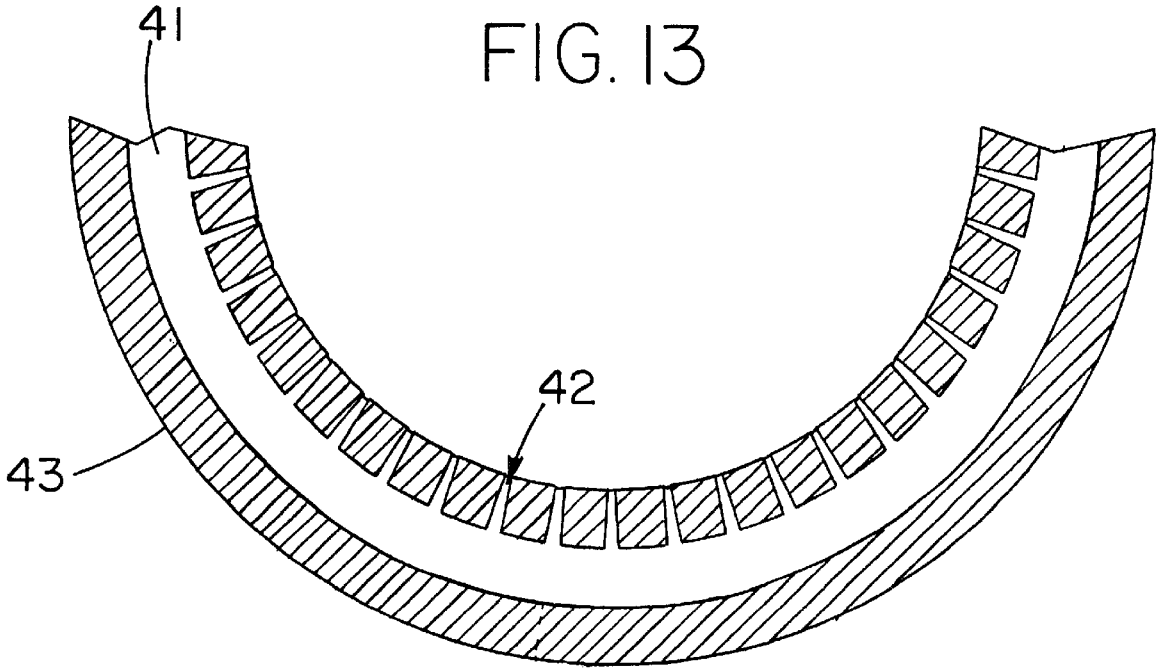
FIG. 13 is a schematic cross sectional view of the present invention.
Figure 14:
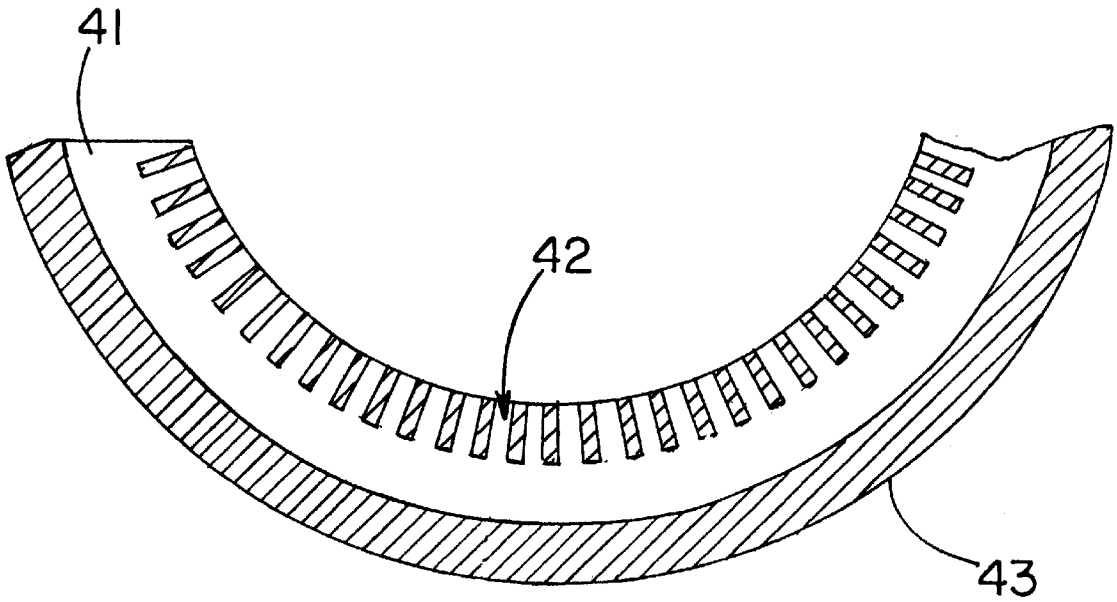
FIG. 14 is a schematic cross sectional view of the present invention.
Figure 15:
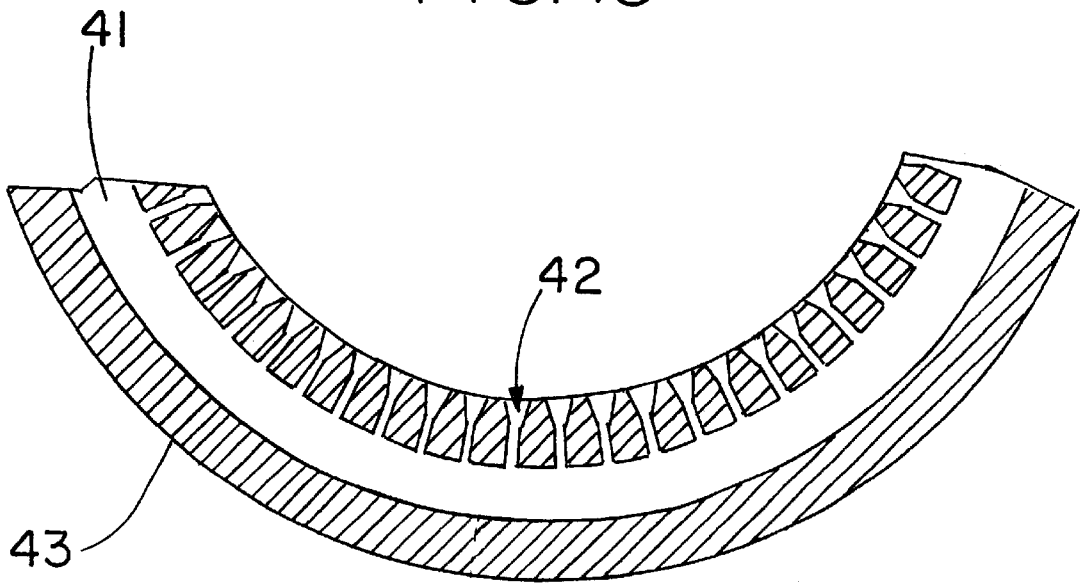
FIG. 15 is a schematic cross sectional view of the present invention.
Figure 17:
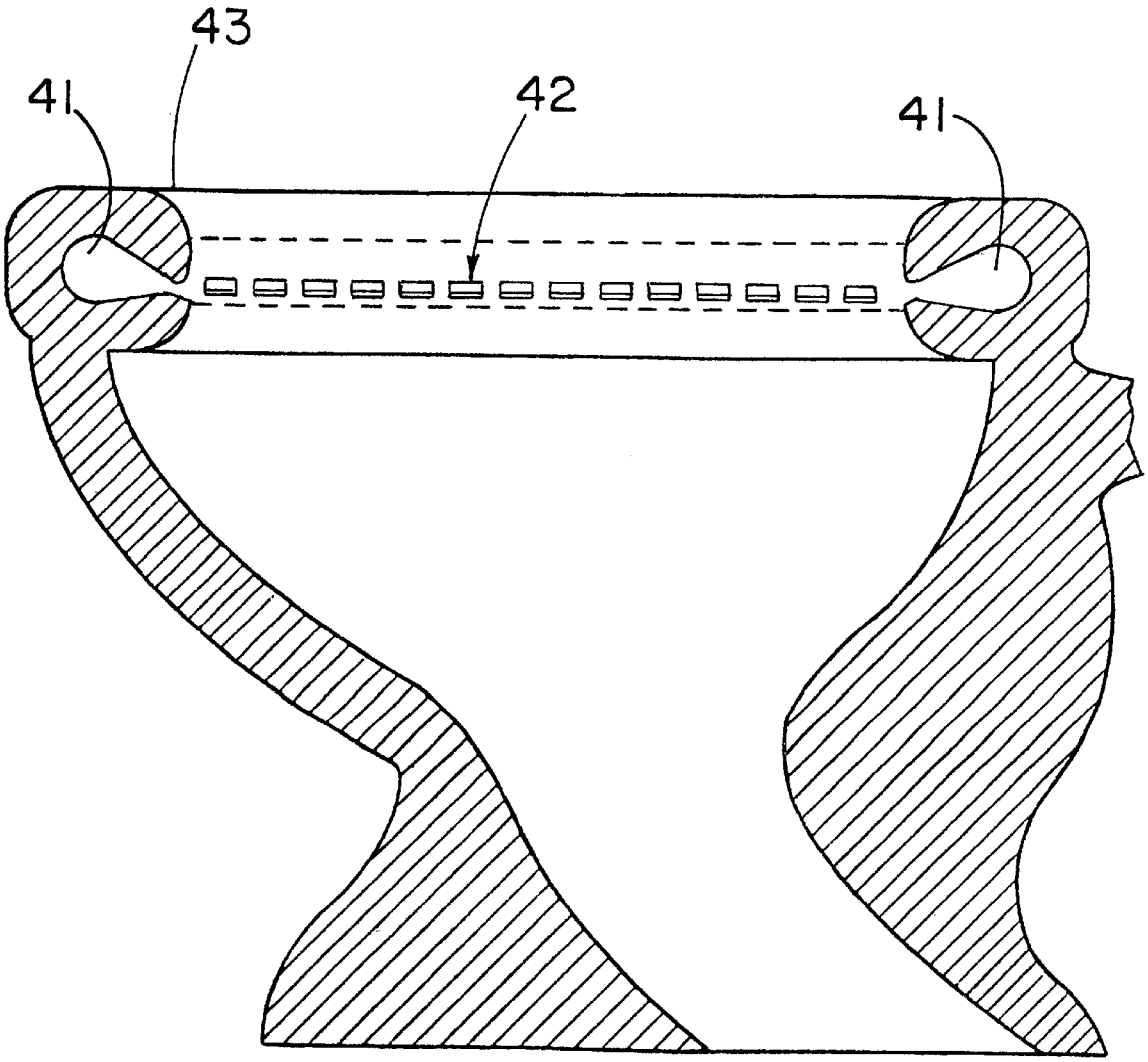
FIG. 17 is a schematic cross sectional view of an alternate embodiment of the present invention.
Figure 18:
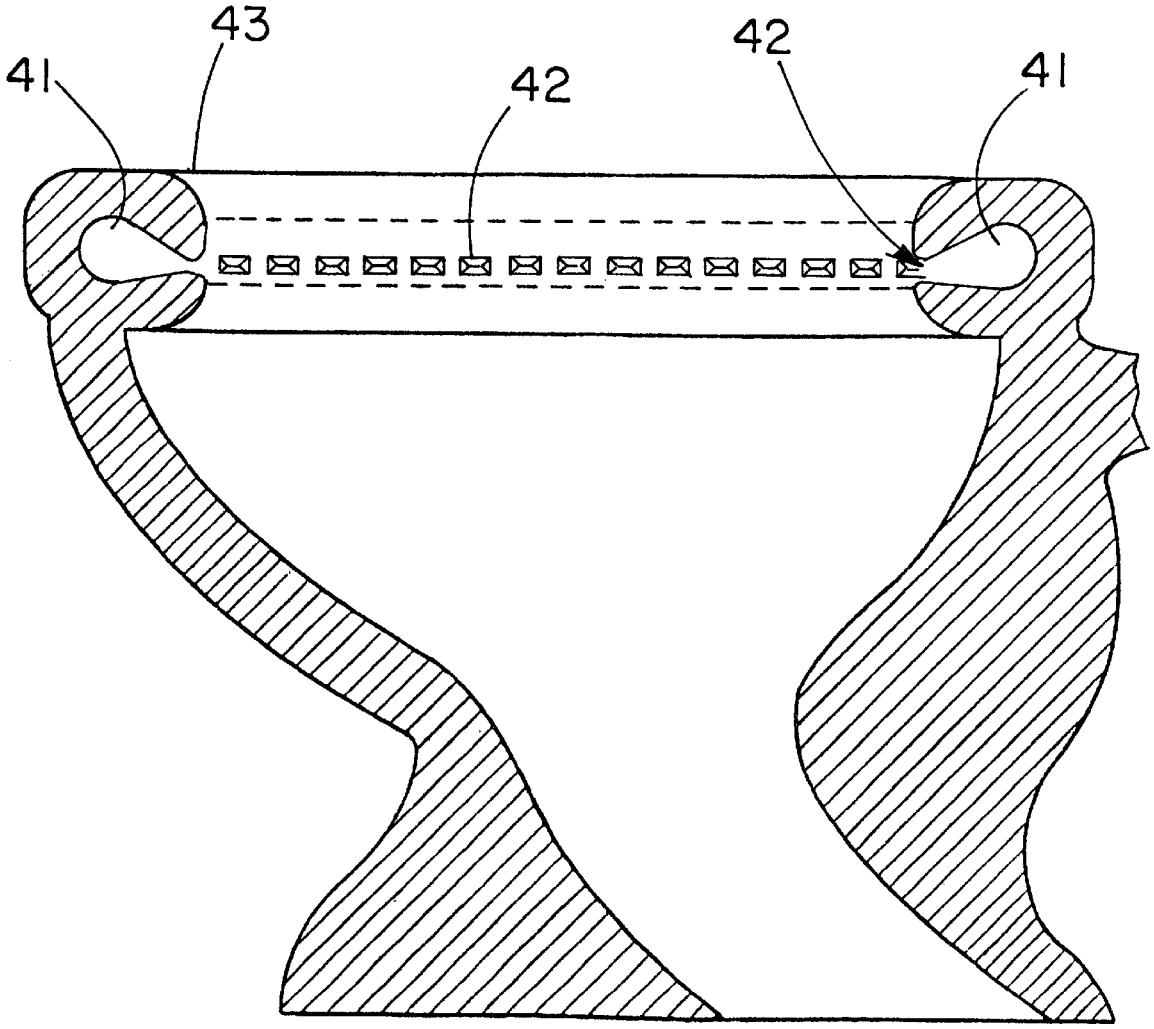
FIG. 18 is a schematic cross sectional view of the alternate embodiment of the present invention.

The vent holes may be round or tubular, as shown in FIG. 11. Alternate vent holes include a rectangular configuration, shown in FIGS. 14 and 17, and conical vent holes, shown in FIGS. 15 and 18. The rectangular vent holes provide more of a blanket of air than the circular version. The jets of air ejected from the conical vent holes travel faster than the air exiting the round vent holes. In any of these embodiments, the bore could extend out and taper together towards the vent holes, as best seen in FIGS. 17 and 18.

Where round vent holes are used, an inner diameter of each of the vent holes is preferably between 1 and 5 mm. Ideally, the vent holes are spaced between 3 and 10 mm apart from the outer edges thereof. This spacing is close enough that a "shield" effect is created, much like a blanket of air.

Figure 16:
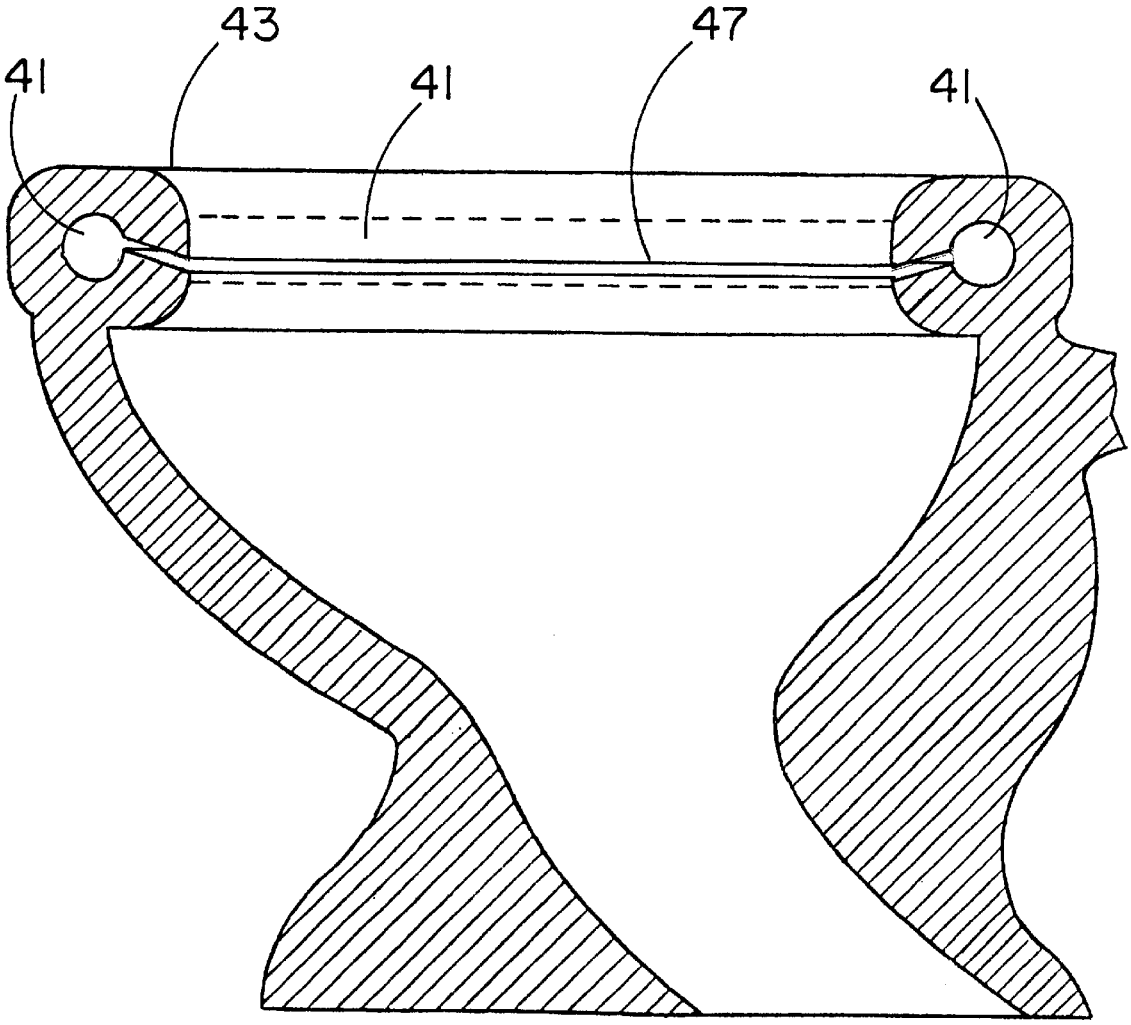
FIG. 16 is a schematic cross sectional view of the present invention.

Alternatively, as illustrated in FIG. 16, the rim could have a vent slot 47 extending outwardly from the bore through an inner perimeter of the rim. Again, the vent slot should angled downwardly at an angle of at least one degree from a horizontal plane, but not over 45 degrees.

An air pump is in communication with the bore of the rim. The air pump should be capable of producing an output of 10 to 500 psi. Exemplary air pumps include rotary blowers as well as fans with radial blades.

A number of activating means or devices may be employed to activate the air pump under various conditions, including the following devices. A seat switch 27 may be mounted to an upper surface of the rim of the toilet bowl and be in electrical communication with the air pump. The switch would activate the pump when the toilet seat is raised. The switch would deactivate the pump when the toilet seat is lowered.

An override switch 28 may disconnect the seat switch from the air pump. This would be useful in a household having children or child guests who would play with the toilet seat merely to activate the device. More importantly, it would allow the user to turn the air pump off when cleaning the toilet bowl.

Alternatively or in any combination with the above switches, a pressure transducer 29 is coupled to an upper surface of a toilet seat and in communication with the air pump. The pressure transducer activates the air pump when a user sits on the toilet seat.

Alternatively or in any combination with the above switches, a temperature transducer 30 is coupled to an upper surface of a toilet seat and in communication with the air pump. The temperature transducer senses the body heat of a user sitting on the toilet seat whereupon it activates the air pump.

Alternatively or in any combination with the above switches, an auxiliary switch 31 may be in communication with the air pump for selectively activating the air pump independent of the seat switch. This would be used when the seat is not raised and would ideally be located near the toilet flushing handle for convenience.

Alternatively or in any combination with the above switches, an abort switch 32 may be used to deactivate the air pump. As shown in FIG. 9, all of the switches would be connected to the abort switch. The abort switch allows a user to completely shut down the system, especially necessary when cleaning the toilet, where any of the number of switches could be accidentally activated.

The modified toilet bowl is used in the same manner as the splash shield set forth above.

Figure 19:
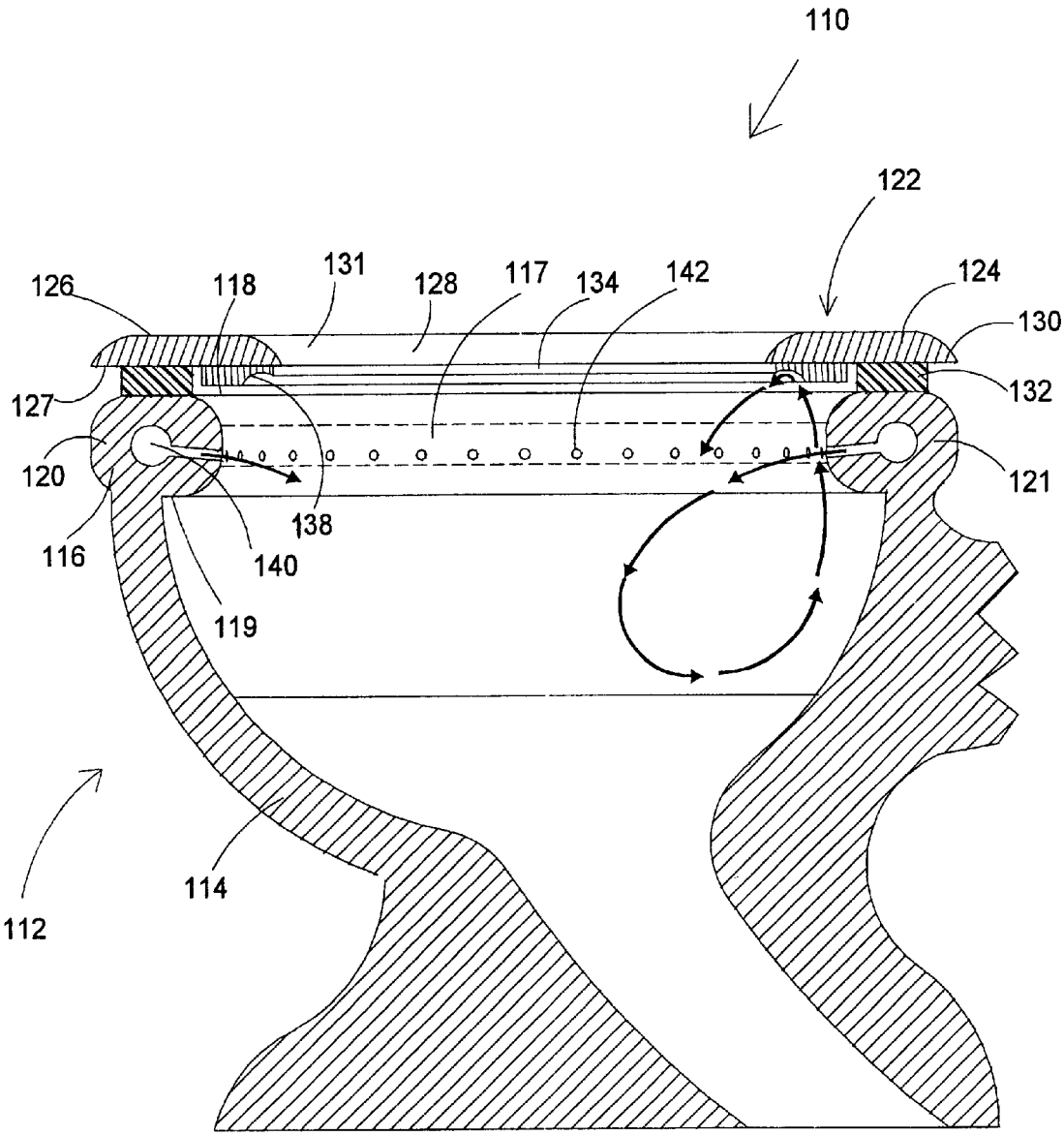
FIG. 19 is a schematic side sectional view of a toilet with further aspects of the improved toilet splash shield system including the gasket member and the air directing member of the invention.
Figure 20:
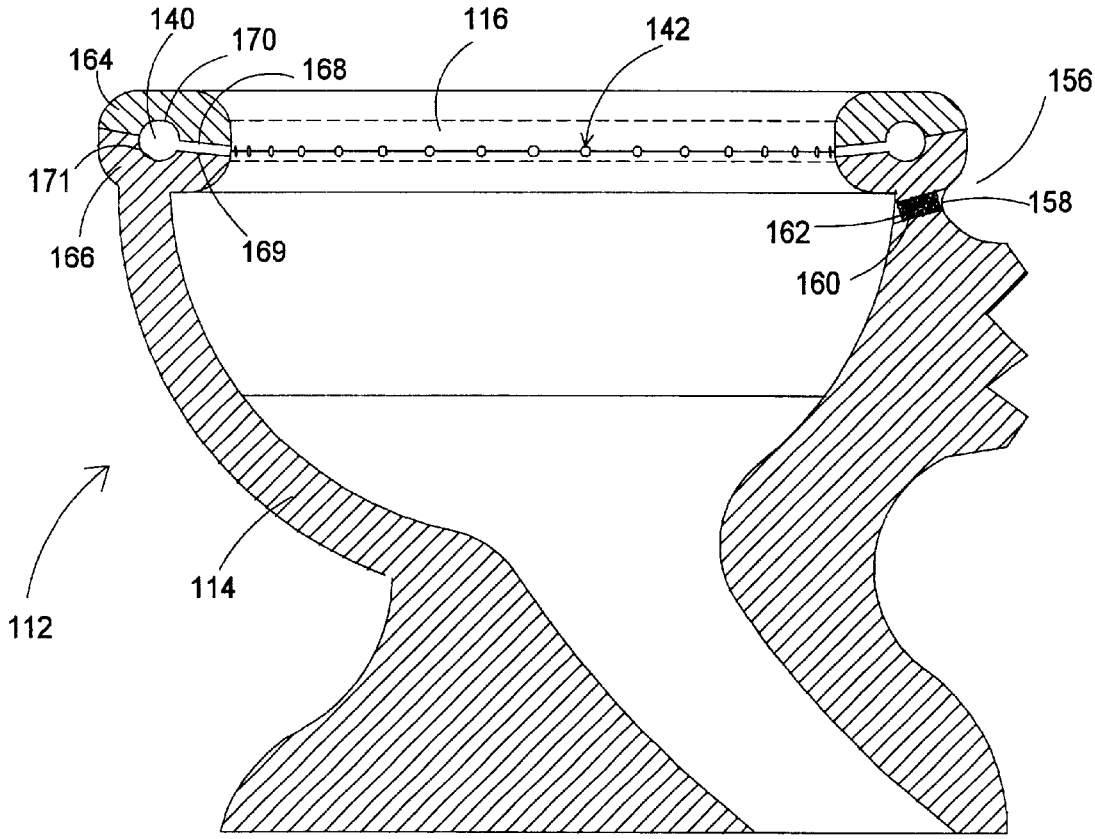
FIG. 20 is a schematic side view a toilet with the two piece rim structure and air exhaust structure of the present invention.
Figure 21:
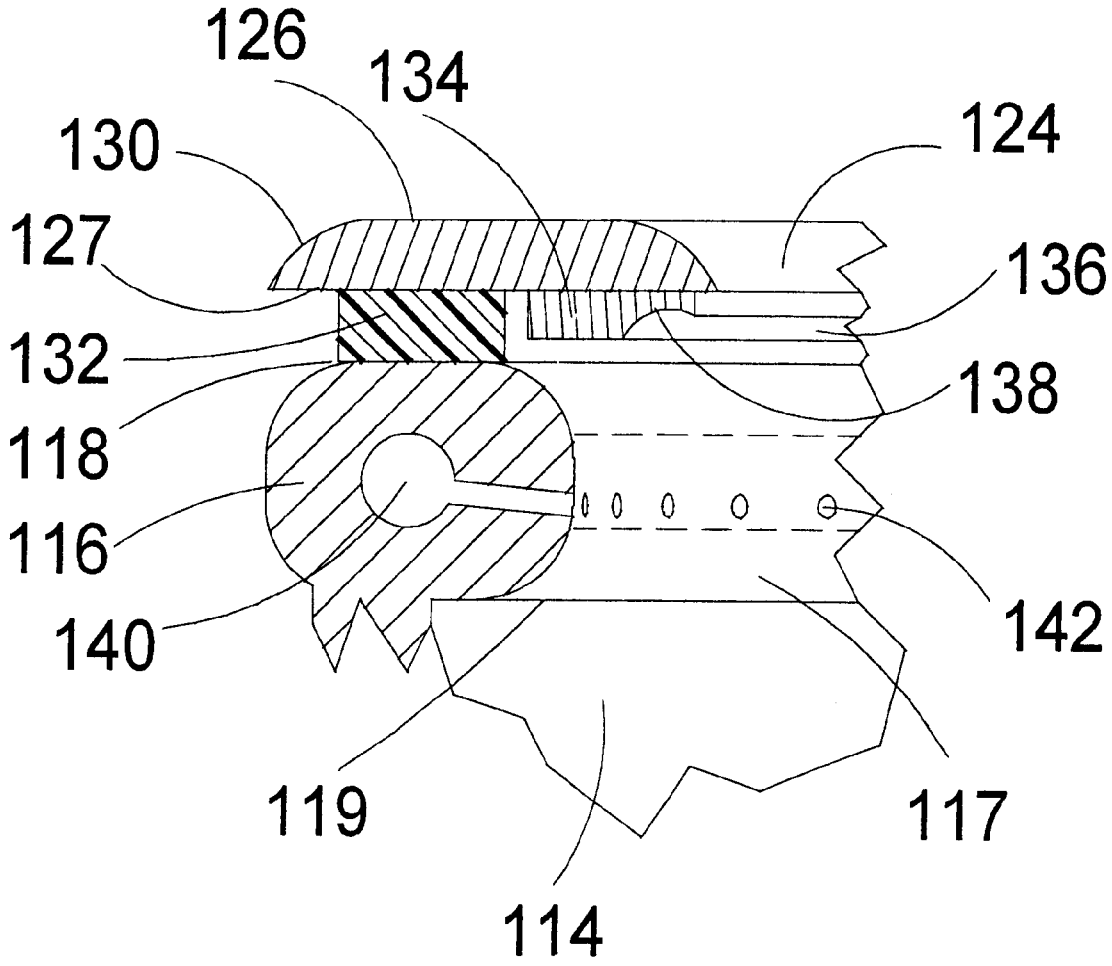
FIG. 21 is a schematic enlarged sectional view of a portion of the showing in FIG. 19.
Figure 22:
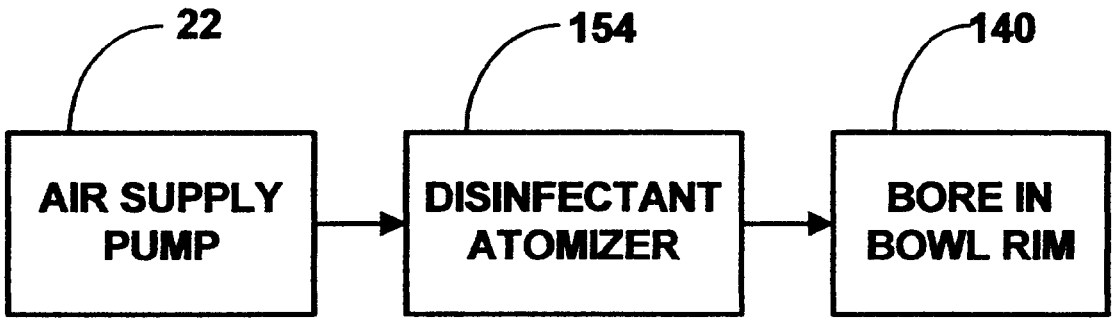
FIG. 22 is a schematic diagrammatic view of one aspect of the invention employing a disinfectant dispenser system.

Optionally, as best illustrated in FIGS. 19 through 21, a further improved toilet splash shield system 110 may generally comprise a toilet 112, a seat assembly 122, a gasket member 132, an air directing member 134, and an air exhaust structure 156.

A toilet 112 suitable for use with the invention comprises a lower bowl 114 having an interior for holding water. The toilet also includes an upper rim assembly formed along an upper section of the bowl and defining an opening 117 into the interior of the toilet. The upper rim assembly comprises a rim 116 having upper 118 and lower 119 sides and front 120 and back 121 ends.

The seat assembly 122 is positioned adjacent to the upper side of the rim (see FIG. 19). The seat assembly includes a seat 124 pivotally mounted on the rim for permitting pivoting of the seat from a lowered position oriented adjacent the rim and a raised position oriented substantially perpendicular to the rim. The seat has an upper face 126 and a lower face 127 and a central opening 128. The seat also has an outer perimeter 130 and an inner perimeter 131, with the inner perimeter defining the central opening.

A gasket member 132 is provided for blocking air flow between the seat 124 and the rim 116 of the toilet. The gasket member 132 is mounted on the lower face 127 of the seat so that the gasket member is positionable between the seat and the upper aide of the rim when the seat is located in the lowered position. The gasket member is preferably formed of a compressible material for forming a snugly-fitting barrier between the seat and rim when the seat is in the lowered position. The gasket member is positioned between the inner 131 and outer 130 perimeters of the seat. The gasket member suitably has an annular shape surrounding the central opening 128 of the seat.

An air directing member 134 is provided for directing air flowing adjacent to the lower face 127 of the seat. The air directing member is mounted on the lower face of the seat. The air directing member may be positioned adjacent to the inner perimeter 131 of the seat, preferably between the gasket member 132 and the inner perimeter 131 of the seat. The air directing member has a directing surface 136 with a directing groove 138 formed thereon which is oriented downwardly toward the bowl and toward air flowing about the bowl, such as from the splash shielding system. Significantly, the channel is employed to redirect air rising from the bowl toward the seat in a manner that produces a secondary splash shielding air flow, as shown in FIG. 19. As is clearly illustrated in FIG. 19, air flowing upwardly from the interior of the lower bowl toward the air directing member is guided by the air directing member toward a center of an interior of the lower bowl. This air flow from the channel of the directing member is oriented substantially parallel to air flowing out of the vent holes of the splash shielding system, which will now be described in greater detail.

The splash shielding system includes a bore 140 formed in a central area of the rim 116 and extending along the rim in a substantially continuous loop. A plurality of vent holes 142 are formed in the rim, and the vent holes extend between an inner perimeter of the rim and the bore 140 so the air in the bore is able to flow into the bowl of the toilet.

Significantly, an air exhaust structure 156 is provided for exhausting air from the interior of the bowl, and may provide a vent to any air pressure built up in the interior of the bowl when the splash shielding system is utilized. The air exhaust structure includes an air exhaust port 158 formed through the wall of the bowl. Preferably, the air exhaust port is located adjacent the rim and above the water line in the bowl. The exhaust port preferably comprises a substantially cylindrical channel 160 that has an opening into the interior of the bowl which is located at a vertical level below an opening into the exterior of the bowl. Optionally, other channel shapes may be used. The air exhaust structure includes a replaceable air filter cartridge 162 that is removably received in the channel of the exhaust port such that the cartridge may be replaced by inserting a new cartridge. Optionally, the filtering element of the cartridge may be scented to provide a pleasing scent to air exiting the interior of the bowl.

Another highly preferred aspect of the invention provides a rim having an upper portion 164 and a lower portion 166, with the upper portion of the rim being separable from the lower portion. Preferably, the upper 164 and lower 166 portions meet in a separation plane, and the vent holes 142 of the splash shielding system extend along and lie in the separation plane. The upper portion of the rim may be permanently or removably mounted on the lower portion of the rim, and the lower portion of the rim may be formed as an integral part with the bowl 114. A lower surface 168 of the upper portion 164 preferably has an upper portion 170 of the bore formed therein, and an upper surface 169 of the lower portion 166 has a lower portion 171 of the bore formed therein. In this manner, the spilt rim structure of the rim of the invention can facilitate manufacturing of the bore and vent holes in the rim prior to assembly of the upper and lower rim portions together.

Figure 23:
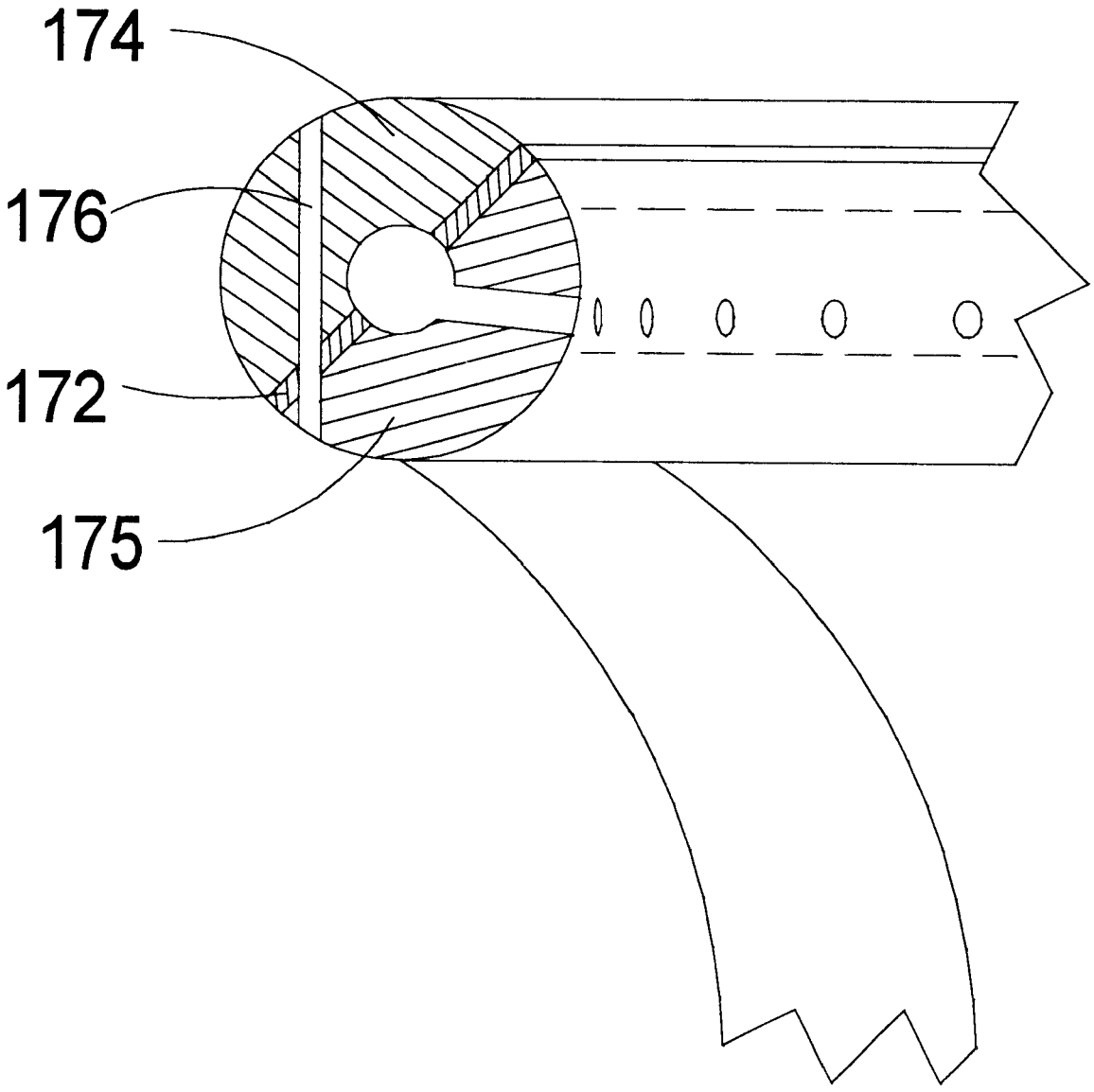
FIG. 23 is a schematic sectional view of a portion of a toilet bowl rim showing an optional configuration of the invention.
Figure 24:
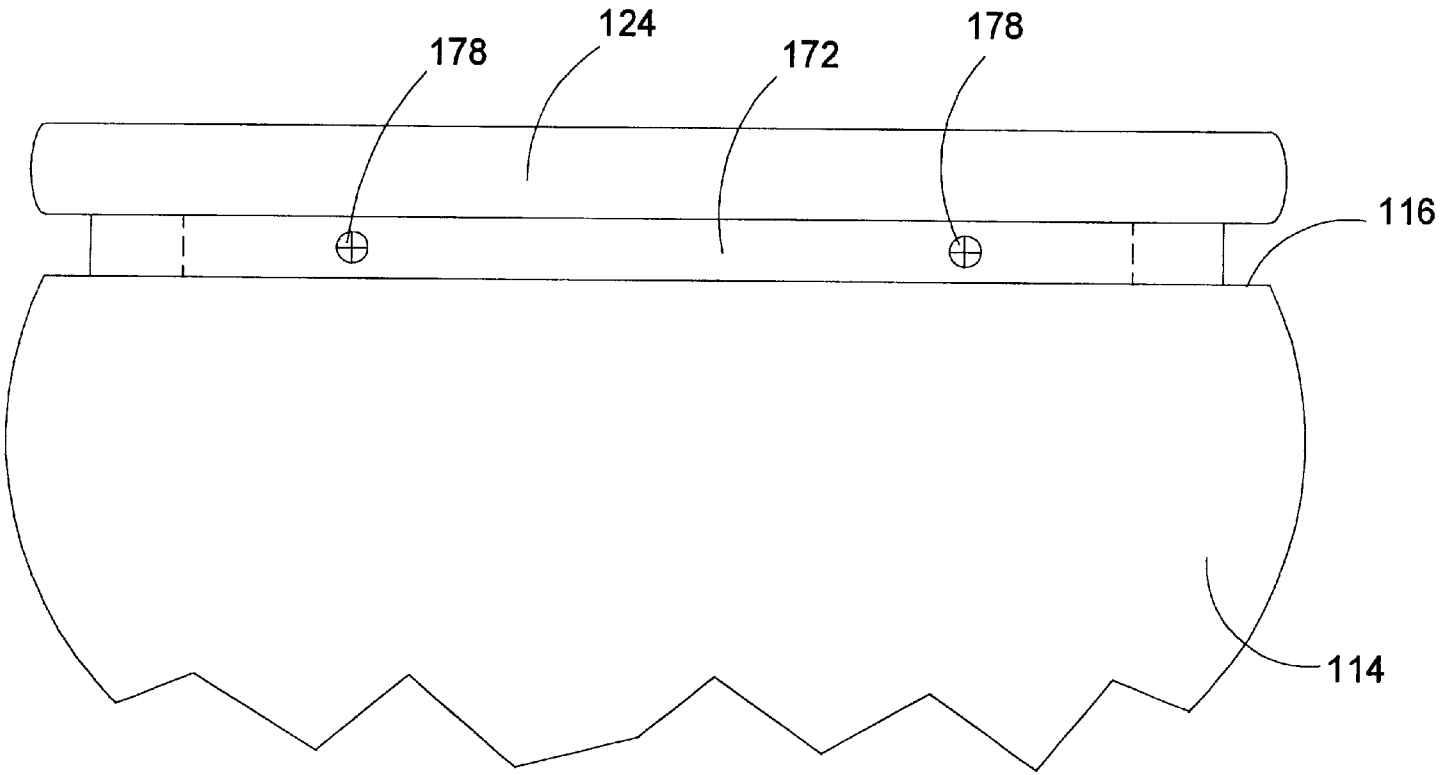
FIG. 24 is a schematic side view of a toilet bowl having an optional gasket embodiment of the invention mounted thereon.

Optionally, the separation plane of the rim may be oriented in a plane that is skewed with respect to the plane of the vent holes (see FIG. 23). As a further option, a gasket 172 may be positioned between the upper 174 and lower 175 portions of the rim for enhanced sealing against air leakage from the bore at the juncture of the upper and lower portions. As a still further option, a fastener channel 176 may be formed in the rim with sections of the channel 176 in each of the upper 174 and lower 175 portions of the rim so that a fastener (not shown) may be positioned in the sections for securing the portions 174, 175 of the rim together.

In conjunction with the air supply pump 22 and the bore 140 in the bowl rim, a disinfectant dispenser 154, such as an atomizer, may be interposed in the air supply line (see FIG. 23) between the pump and the bore for dispensing a disinfectant into the air flow for disinfecting and sanitizing the interior of the bowl through the air flowing through the system of the invention.

The gasket 172 may optionally be provided with one or more valves 178 (see FIG. 24) that permit air flow in an inward direction through the wall of the gasket toward the interior of the bowl for preventing the formation of a relatively lower pressure condition in the bowl with respect to outside the bowl when a user is seated on the toilet seat with the gasket in position. The valve 178 may comprise a flexible, pliable plastic diaphragm mounted in a hole formed in the gasket.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A splash shielding system, comprising:

a toilet having a lower bowl having an interior and an upper rim assembly, the upper rim assembly being formed along an upper section of the bowl, the upper rim assembly comprising a rim having an upper side, a bore being formed in a central area of the rim and extending along the rim, a plurality of vent holes being formed in the rim, the vent holes extending between an inner perimeter of the rim and the bore;

a seat assembly being positioned adjacent to the upper side of the rim, the seat assembly including a seat pivotally mounted on the rim for permitting pivoting of the seat from a lowered position oriented adjacent the rim and a raised position oriented substantially perpendicular to the rim, the seat having a lower face, the seat having an outer perimeter and an inner perimeter, the inner perimeter defining a central opening, the inner perimeter having an inner perimeter edge; and a splash shielding system for shielding a user from splashing in the interior of the bowl, the splash shielding system including an air pump being in communication with the bore of the rim and being adapted to move air into the bore when the air pump is activated, and activating means for activating the air pump;

wherein the rim of the toilet comprises an upper portion and a lower portion, the upper portion of the rim being separable from the lower portion, the upper portion being removably mounted on the lower portion of the rim.

2. The system of claim 1 wherein the upper and lower portions of the rim meet in a separation plane, and the vent holes in the rim extend along the separation plane, the lower portion of the rim being mounted on the bowl, a lower surface of the upper portion having a portion of the bore formed therein, an upper surface of the lower portion having a portion of the bore formed therein.

3. The system of claim 1 wherein the seat assembly comprises a gasket member for blocking air flow between the seat and the rim of the toilet, the gasket member being positionable between the seat and the upper side of the rim when the seat is located in the lowered position.

4. The system of claim 1 wherein the seat assembly comprises an air directing member for directing air flowing adjacent to the lower face of the seat, the air directing member being mounted on the lower face of the seat, the air directing member having a directing surface with a directing groove formed thereon.

5. The system of claim 4 wherein the air directing member is positioned adjacent to the inner perimeter of the seat.

6. The system of claim 1 additionally comprising an air exhaust structure for exhausting air from the interior of the bowl, the air exhaust structure including an air exhaust port extending through the wall of the bowl.

7. The system of claim 6 wherein the air exhaust structure includes a replaceable air filter cartridge removably received in the air exhaust port.

8. A splash shielding system, comprising:

a toilet having a lower bowl having an interior and an upper rim assembly, the upper rim assembly being formed along an upper section of the bowl, the upper rim assembly comprising a rim having an upper side, a bore being formed in a central area of the rim and extending along the rim, a plurality of vent holes being formed in the rim, the vent holes extending between an inner perimeter of the rim and the bore;

a seat assembly being positioned adjacent to the upper side of the rim, the seat assembly including a seat pivotally mounted on the rim for permitting pivoting of the seat from a lowered position oriented adjacent the rim and a raised position oriented substantially perpendicular to the rim, the seat having a lower face, the seat having an outer perimeter and an inner perimeter, the inner perimeter defining a central opening, the inner perimeter having an inner perimeter edge;

a splash shielding system for shielding a user from splashing in the interior of the bowl, the splash shielding system including an air pump being in communication with the bore of the rim and being adapted to move air into the bore when the air pump is activated, and activating means for activating the air pump; and an air exhaust structure for exhausting air from the interior of the bowl, the air exhaust structure including an air exhaust port extending through the wall of the bowl.

9. The system of claim 8 wherein the air exhaust structure includes a replaceable air filter cartridge removably received in the air exhaust port.

10. The system of claim 8 wherein the seat assembly comprises a gasket member for blocking air flow between the seat and the rim of the toilet, the gasket member being positionable between the seat and the upper side of the rim when the seat is located in the lowered position.

11. The system of claim 8 wherein the seat assembly comprises an air directing member for directing air flowing adjacent to the lower face of the seat, the air directing member being mounted on the lower face of the seat, the air directing member having a directing surface with a directing groove formed thereon.

12. The system of claim 11 wherein the air directing member is positioned adjacent to the inner perimeter of the seat.

* * * * *